US007717259B2

(12) United States Patent
Hatton

(10) Patent No.: US 7,717,259 B2
(45) Date of Patent: May 18, 2010

(54) TOBACCO AND CIGARETTE CONTAINER WITH POKER AND MAGNETIC CLOSURE

(75) Inventor: Christopher Hatton, Athens, GA (US)

(73) Assignee: Volo Trading, Athens, GA (US)

( * ) Notice: Subject to any disclaimer, the term of this patent is extended or adjusted under 35 U.S.C. 154(b) by 192 days.

(21) Appl. No.: 11/764,874

(22) Filed: Jun. 19, 2007

(65) Prior Publication Data

US 2008/0314778 A1 Dec. 25, 2008

(51) Int. Cl.
*A24F 15/00* (2006.01)

(52) U.S. Cl. ..... 206/236; 206/86; 206/265; 206/818

(58) Field of Classification Search ..... 206/236, 206/818, 443, 371, 265, 85, 86, 92, 242, 206/248; 131/329, 253, 254
See application file for complete search history.

(56) References Cited

U.S. PATENT DOCUMENTS 3,758,262 A * 9/1973 Harris ..... 431/130
3,763,996 A * 10/1973 Shepherd ..... 206/87
4,214,658 A * 7/1980 Crow ..... 206/244
D348,329 S * 6/1994 Signorelli ..... D27/194
5,465,738 A * 11/1995 Rowland ..... 131/329
5,967,310 A * 10/1999 Hill ..... 206/242
6,260,554 B1 * 7/2001 Rowland et al. ..... 131/181
2002/0088469 A1 * 7/2002 Rennecamp ..... 131/330
2004/0206638 A1 * 10/2004 Metzler et al. ..... 206/1.5
2005/0236005 A1 * 10/2005 Bears et al. ..... 131/235.1
2005/0247582 A1 * 11/2005 Rennecamp ..... 206/236

* cited by examiner

*Primary Examiner*—J. Gregory Pickett
*Assistant Examiner*—King M Chu
(74) *Attorney, Agent, or Firm*—Ostrolenk Faber LLP

(57) ABSTRACT

A container for holding a smoker's article. The container has a lid and a body. The body includes a first chamber for holding smoker's articles, and a second chamber for holding a cigarette or a pipe. The lid is rotatably supported atop the container and is rotatable between the position covering both, or at least partially covering one or the other of the two chambers. A magnet in the body cooperates with a magnet in the lid for retaining the lid in the closed position over both chambers. A third small hole or chamber in the body is shaped to receive a magnetized element such as a poker. A magnet at the top of the body removably magnetically retains the poker in its chamber.

9 Claims, 2 Drawing Sheets

TOBACCO AND CIGARETTE CONTAINER WITH POKER AND MAGNETIC CLOSURE

BACKGROUND OF THE INVENTION

The invention concerns a smoking system and more particularly a smoking system to hold smoking tobacco, a pipe and/or a cigarette and additionally a metallic poker. The invention concerns a container or case and lid with a novel closure. It has a similar purpose to and is an improvement on the smoking system disclosed in U.S. Pat. No. 4,214,658.

U.S. Pat. No. 4,214,658 discloses a container with separate chambers for receiving a pipe, or a tubular item in one chamber and for receiving other smoking material, such as loose tobacco, in another chamber. A lid over the container covers the openings into the two chambers and the lid is slid laterally in a slideway to allow access to one or the other chamber.

In the '658 patent and other prior art, the lid of a container for a smoking system is attached mechanically, e.g., by being slid between positions or by being otherwise attached to the top of the container. The present invention concerns another mode of attachment of a lid.

Further, if a smoking system includes a metal poker, which would be used for example to clean a pipe or to work with tobacco in a pipe bowl, and the poker is made of metal, particularly steel, the prior art does not disclose a manner of using the material of the poker for securely retaining the poker in the container of the system. In contrast, the present invention provides the possibility of securely retaining a metal poker in the container by using the material of the poker.

SUMMARY OF THE INVENTION

The object of the invention is to provide a smoking system including receptacles for holding smoking materials, such as tobacco, possibly a cigarette and possibly a pipe, and a metallic poker that might be used, for example, for working with or on a pipe.

The invention concerns a container for holding and storing smoking articles. The container includes at least two separate chambers, one for holding loose tobacco or loose smoking material, and the second one sized and shaped to hold a cigarette or pipe. A third chamber provides a means for holding the poker.

A wall inside the container separates the first and second chambers. The wall inside the container may include an additional hole, i.e., the third chamber, which is shaped and sized to receive a poker extending into the wall from below. The poker is typically used to compact tobacco in a pipe or for cleaning the pipe. Since the poker is typically made of steel and is attracted to a magnet, the system includes a magnet positioned preferably in the top of the hole or third chamber to retain the poker in a removable manner within its small hole or chamber. The poker can be removed simply by hand.

A lid attached to the top of the container is preferably rotatable around a pivot at the top of the container, preferably in the wall inside the container. In a closed position, the lid covers the tobacco chamber and other smoking article chamber, and prevents access into the chambers and prevents material exiting the chambers. In a first rotated position, the lid may block the cigarette or pipe chamber while providing free access to the tobacco chamber. In a second rotated position, the lid may at least partially cover the tobacco containing chamber while leaving the cigarette or pipe chamber uncovered.

In order to retain the poker in its hole or third chamber, the lid has an additional magnet which is positioned to be over the top of the hole or third chamber when the lid is closed. This magnet holds the poker in the hole magnetically when the poker is not in use while it enables the poker to be easily removed from the container for use.

Prior art systems do not disclose a poker held magnetically. Further, there is a novel lid closure on the container of the invention which is not suggested in the prior art reference. It includes a magnetic lock in the lid closed condition.

Other features and advantages of the invention will become apparent form the following detailed description, taken in conjunction with the accompanying drawings, which illustrates by way of example the principle of the invention.

DESCRIPTION OF A PREFERRED EMBODIMENT

Figure 3:
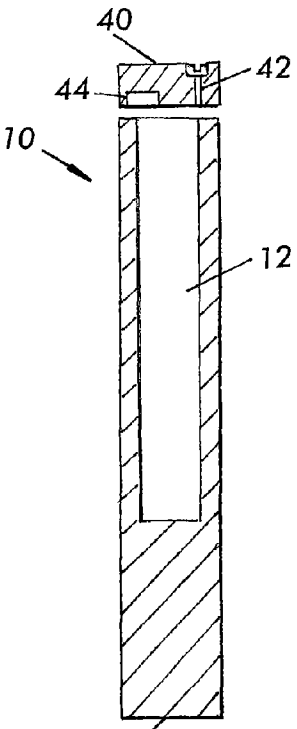
FIG. 3 is a cross sectional, side view of the container shown in FIG. 1.

The container 10 for a smoking system of the invention includes two separate chambers, including a first chamber 12 for tobacco or loose smoking material and a separate second chamber 14 sized and shaped to hold a cigarette, and which alternatively may be shaped and sized for holding a pipe or another smoker's article. A wall 18 inside the container separates the chambers 12 and 14 and is thick enough to also rigidify the container.

Figure 2:
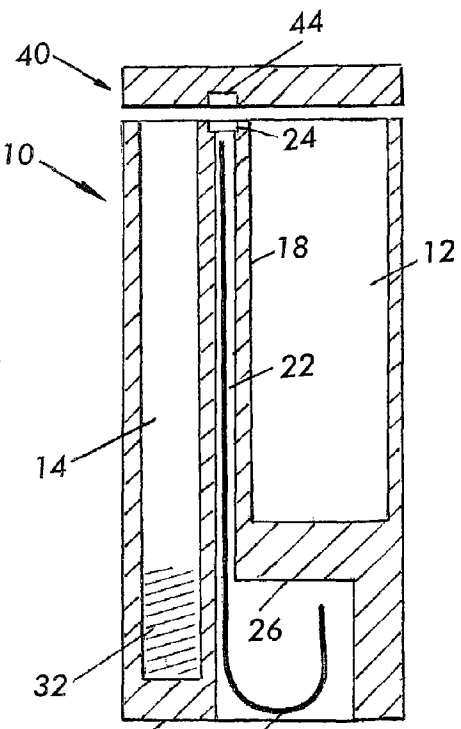
FIG. 2 is a front cross section of the container shown in FIG. 1.
Figure 5:
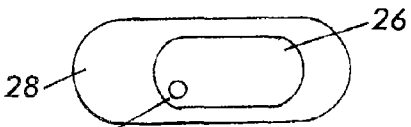
FIG. 5 is a bottom view of the container shown in FIG. 1.
Figure 4:
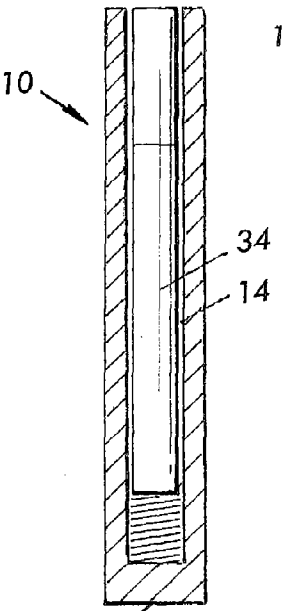
FIG. 4 is an opposite side cross-sectional side view of the view shown in FIG. 3.

Further, as seen in FIGS. 2 and 5, the wall 18 has a third chamber or hole 22 extending into it from below, shaped and sized, e.g., with a diameter of 3.2 mm, to receive a poker 23 that may be used for compacting tobacco in a pipe or for cleaning a pipe, for example.

As seen in FIGS. 2 and 5, the body 10 of the container includes a large and deep notch or recess 26 at its underside 28, in which the curved, hooked end region of a poker 23 may be contained. The notch or recess 26 is large enough, e.g., 11 mm wide across the narrow dimension of the body, so that a finger can be inserted in the recess in order to grab the poker. This recess or notch 26 also shortens the height of the chamber 12 in comparison with the height of the chamber 14. The top wall defining the recess 26 closes the bottom of the chamber 12. The underside 28 of the container covers the bottom of the cigarette chamber 14.

A compressible, normally extended spring 32 may be disposed inside the chamber 14. It exerts only light spring force, sufficient to push a cigarette 34 slightly out of the chamber 14 when the below described lid 40 opens the top end of the chamber 14.

At the top end of the poker hole 22 in the wall 18 is installed a first permanent magnet 24, which closes the top end of the poker hole 22. The poker 23 is typically made of steel and is magnetically attracted to the magnet 24. This magnetic attraction between the poker 23 and the magnet 24 retains the poker in the hole 22 when the poker 23 is not in use, but enables simple removal of the poker by the hand of a user when the poker is to be extracted from the container 10. The magnet 24 serves an additional function of holding the lid 40 in its closed position, as described below. For this reason, the top of the magnet 24 is also exposed at the top side of the container 10.

Figure 1:
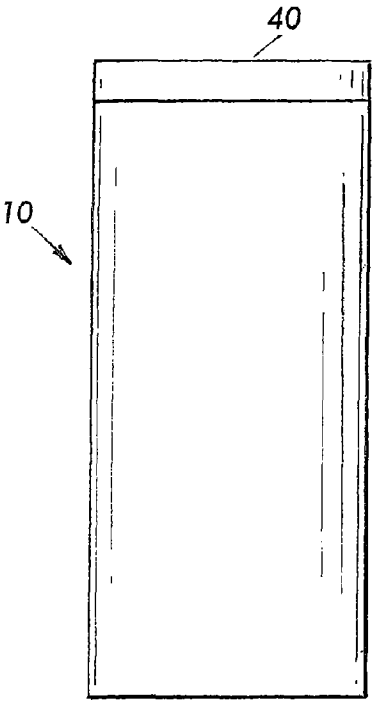
FIG. 1 is an external view of a container with lid closure of the present invention.
Figure 8:
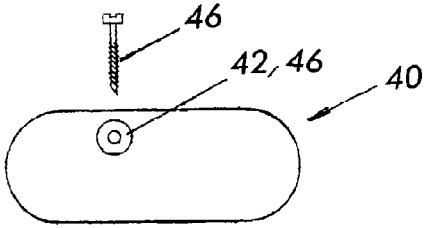
FIG. 8 is a top view of the lid for the container shown in FIG. 1.
Figure 7:
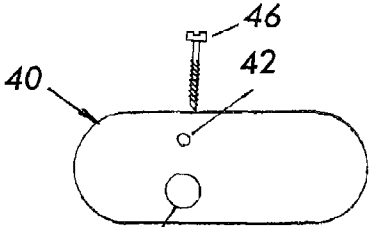
FIG. 7 is a bottom view of a lid for the container shown in FIG. 1.
Figure 6:
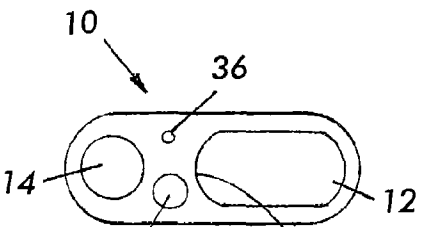
FIG. 6 is a top view of the container shown in FIG. 1.
Figure 10:
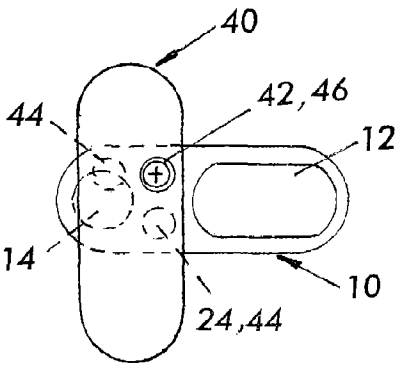
FIG. 10 illustrates the lid shown in FIG. 9 opened in one orientation.

The top side of the container 10 at the wall 18 has a screw shank receiving hole 36 at which the below described lid 40 is attached. A lid 40 for being attached on the container 10 has the same peripheral profile as the container 10, as seen in FIGS. 1,6 and 10. The lid has a screw hole 42 through it, which is alignable with the screw receiving hole 36 in the wall 18 of the container 10. A screw 46 is passed through the lid hole 42 and is threaded into the container hole 36. This holds the lid 40 to the container 10 and enables positioning the lid 40 in a manner which enables the lid 40 to be rotated around the screw 46 to pivot between three positions illustrated in FIGS. 9, 10 and 11.

Figure 9:
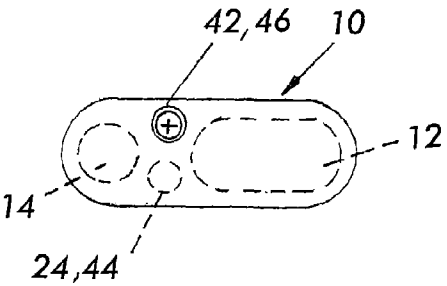
FIG. 9 is a top view of the lid showing the lid covering the top of the container shown in FIG. 1.

To retain the lid 40 in a closed position of FIG. 9 blocking the open top ends of both of the chambers 12 and 14, a second permanent magnet 44 is disposed on the underside of the lid 40 and is positioned to directly overlie and be aligned with the magnet 24 exposed at the top of the container wall 18 when the lid 40 is closed over the body, as shown in FIG. 9. When the lid 40 is in the closed position and the magnets 24 and 44 are aligned as in FIG. 9, the lid 40 is held in the closed position by the cooperating magnets 24 and 44.

Figure 11:
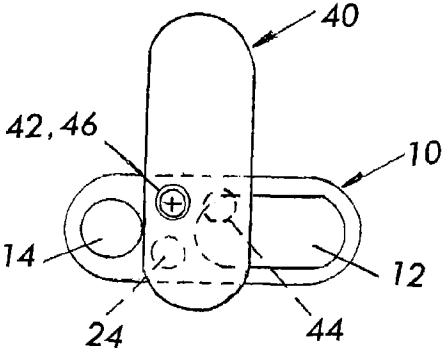
FIG. 11 illustrates the lid shown in FIG. 9 opened in a different orientation to that shown in FIG. 10.

Various positions of the lid with respect to the body and the chambers 12 and 14 are illustrated in FIGS. 9, 10 and 11. The closed position is illustrated in FIG. 9 with the lid 40 covering the top ends of both of the chambers 12 and 14. When it is desired to extract tobacco or other smoker's article from the tobacco chamber 12, the lid 40 is rotated in one direction as in FIG. 10 around the pivot at 42, 46 to expose the chamber 12, providing access so that that tobacco may be removed from that chamber 12, while blocking the chamber 14 so that anything in the chamber 14, like a cigarette, would not be removable and would not pop out.

By rotating the lid 40 further to the position shown in FIG. 11, the chamber 12 is at least in part blocked and the chamber 14 is unblocked. The spring 32 in the chamber 14 would force the cigarette or the pipe within that chamber 14 to extend out from the top of the chamber 14 where it could be extracted, without having to invert the container 10 with the open end down, and so that tobacco or loose material within the chamber 12 would not fall out while a cigarette is being extracted. Continuing to rotate the lid 40 around its pivot 42, 46 brings it back to the closed position or one of the alternate open positions.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A container for a smoker's articles, the container having a top end, a longitudinal extent transverse to the top end, and a bottom end transverse to the longitudinal extent and at an opposite side of the container than the top end, the container including:

a first chamber configured to receive a first smoker's article, or loose tobacco and a second chamber adjacent the first chamber configured to receive a second smoker's article, the first and second chambers opening at the top end to provide access into the first and second chambers; and a lid positioned over the top end of the container, the lid having a closed position blocking access into the first and second chambers, the lid being rotatable about an axis parallel to the longitudinal extent of the container, the rotation being between a first position at which the lid provides at least a partial opening to the first chamber and a second position at which the lid provides at least a partial opening to the second chamber;

a third chamber extending parallel to the longitudinal extent of the container and comprising a closed top end immediately adjacent the top end of the container, a wider lower portion, and a bottom opening of the wider lower portion at the bottom end of the container, the third chamber configured to receive a metallic smoker's article; and a container magnet positioned at the closed top end of the third chamber and below the lid shaped and positioned so that the magnet covers at least a majority of the closed top end of the third chamber so that when the metallic smoker's article is received inside the third chamber, the container magnet is magnetically attracted to and magnetically retains the metallic smoker's article in the third chamber.

2. A container for a smoker's articles, the container having a top end, a longitudinal extent transverse to the top end, and a bottom end transverse to the longitudinal extent and at an opposite side of the container than the top end, the container including:

a first chamber configured to receive a first smoker's article, or loose tobacco and a second chamber adjacent the first chamber configured to receive a second smoker's article, the first chamber and the second chamber opening at the top end to provide access into the first chamber and the second chamber;

a lid positioned over the top end of the container, the lid having a closed position blocking access into the first chamber and the second chamber, the lid being rotatable about an axis parallel to the longitudinal extent of the container, the rotation being between a first position at which the lid provides at least a partial opening to the first chamber and a second position at which the lid provides at least a partial opening to the second chamber;

a third chamber extending parallel to the longitudinal extent of the container and comprising a closed top end immediately adjacent the top end of the container, a wider lower portion, and a bottom opening of the wider lower portion at the bottom end of the container, the third chamber configured to receive a metallic smoker's article; and a container magnet exposed toward the lid at the closed top end of the third chamber and positioned at the closed top end of the third chamber and below the lid, the container magnet being shaped and positioned so that the magnet covers at least a majority of the closed top end of the third chamber so that when the metallic smoker's article is received inside the third chamber, the container magnet is magnetically attracted to and magnetically retains the metallic smoker's article in the third chamber; and a lid magnet positioned at the lid, the lid magnet being positioned to magnetically attract the container magnet, wherein the lid magnet is positioned such that when the lid is in the closed position, the lid magnet overlies the container magnet and the lid and container magnets magnetically retain the lid closed over the top end to close all three chambers, wherein the wider lower portion of the third chamber comprises a notch having a top and an open bottom at the bottom end of the container, the notch sized to receive at least a portion of a finger, wherein the bottom opening of the third chamber is positioned at the top of the notch.

3. The container of claim 1, wherein the second chamber in the container is sized for retaining a cigarette or a pipe.

4. The container of claim 2, further comprising a spring in the second chamber sized, positioned and oriented to urge a cigarette or pipe in the second chamber out of the top end when the lid is in the position opening the second chamber.

5. The container of claim 1, wherein the wider lower portion of the third chamber comprises a notch having a top and an open bottom at the bottom end of the container, the notch sized to receive at least a portion of a finger, wherein the bottom opening of the third chamber is positioned at the top of the notch.

6. The container of claim 1, further comprising a lid magnet positioned at the lid, the lid magnet being positioned to magnetically attract the container magnet at the closed top end of the third chamber, wherein the lid magnet is positioned such that when the lid is in the closed position, the lid magnet overlies the container magnet and the lid and container magnets magnetically retain the lid closed over the top end to close all three chambers.

7. The container of claim 6, wherein the wider lower portion of the third chamber comprises a notch having a top and an open bottom at the bottom end of the container, the notch sized to receive at least a portion of a finger, wherein the bottom opening of the third chamber is positioned at the top of the notch.

8. The container of claim 7, wherein the container magnet is exposed toward the lid at the closed top end of the third chamber.

9. The container of claim 1, wherein the container magnet is exposed toward the lid at the closed top end of the third chamber.

* * * * *